United States Patent [19]

Smith, Jr. et al.

[11] Patent Number: 4,680,884

[45] Date of Patent: Jul. 21, 1987

[54] SAFETY FIREARM MECHANISM

[76] Inventors: Forrest P. Smith, Jr., 35 Gilpin Ave., Hauppauge, Long Island, N.Y. 11787; Jeffrey C. Munnell, 633 Long Run Rd., McKeesport, Pa. 15132

[21] Appl. No.: 818,802

[22] Filed: Jan. 14, 1986

[51] Int. Cl.[4] ..... F41C 17/02

[52] U.S. Cl. ..... 42/66; 42/70.06

[58] Field of Search ..... 42/65, 66, 67, 69.01, 42/70.06

[56] References Cited

U.S. PATENT DOCUMENTS 3,777,384 12/1973 Ruger et al. ..... 42/66

4,228,607 10/1980 Casull ..... 42/66

*Primary Examiner*—Deborah L. Kyle

*Assistant Examiner*—Michael J. Carone

*Attorney, Agent, or Firm*—Harvey B. Jacobson

[57] ABSTRACT

A firearm mechanism having an external hammer manually moved to a cocked position with a transfer bar moving into position between the hammer and firing pin to transfer impact of the hammer to the firing pin with the improvement in this invention including a flipper assembly associated with the hammer and trigger to prevent movement of the trigger and transfer bar unless the hammer has been retracted from its at rest position down against the frame.

13 Claims, 13 Drawing Figures

SAFETY FIREARM MECHANISM

BACKGROUND OF THE INVENTION

1. Field of the Invention

The present invention generally relates to a safety firearm mechanism and more particularly a mechanism incorporated into a single action revolver and other similar firearms having a manually cocked hammer with the mechanism preventing movement of the trigger to firing position to release the hammer unless the hammer has been retracted from its at rest position down against the frame.

2. Information Disclosure Statement

Single action revolver-type firearms are generally well knwon and include an external hammer that must be manually retracted or cocked before the trigger can be pulled. Prior U.S. Pat. No. 3,777,384 issued to William B. Ruger, et al on Dec. 11, 1973 discloses this type of firearm. The prior art cited in U.S. Pat. No. 3,777,384 disclose other types of firing mechanisms including double action firearms in which the mechanism is cocked by simply pulling the trigger. Single shot firearm mechanisms are also used in other types of firearms including rifles, shotguns or the like and all include an external hammer having a sear notch that is engaged by the sear of the trigger when the hammer is cocked.

SUMMARY OF THE INVENTION

The mechanism of the present invention is associated with firearms having an external pivotally mounted hammer and other normally provided components together with a structure in the form of a flipper associated with the hammer, cylinder latch and transfer bar or ignition plate which facilitates operation of a cylinder latch and prevents upward movement of the transfer bar or ignition plate unless the hammer has been retracted from its at rest position down against the frame.

Accordingly, an object of the present invention is to provide an improved safety firearm mechanism in which the action is very smooth and can be adjusted for accurate operation of the cylinder latch and control of movement of the trigger and transfer bar or ignition plate.

Another object of the invention is to provide a mechanism in accordance with the preceding object in which the flipper engages the trigger arm to stop movement of the trigger and thus the transfer bar so that the transfer bar cannot be raised for engagement by the hammer projection or the firing pin.

A further object of the invention is to provide a firearm mechanism having a novel mounting for the rear sight in which the pivot pin enabling elevational adjustment slides in grooves rather than being exposed to the exterior.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
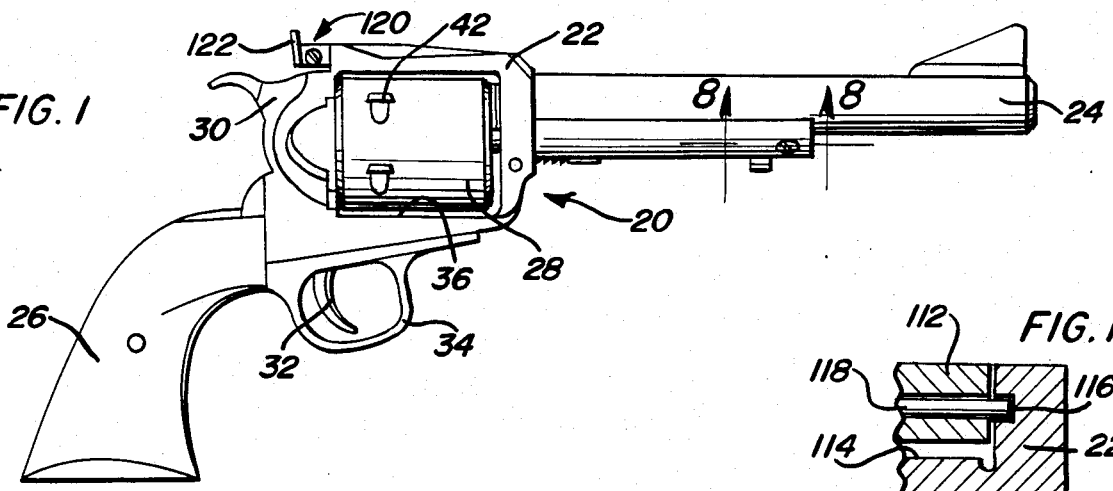
FIG. 1 is a side elevational view of a revolver with the mechanism of the present invention incorporated therein.

The firearm mechanism of the present invention is disclosed in association with a single action revolver 20 with it being understood that the mechanism may be used with various single action firearms including but not limited to rifles, shotguns and the like. The revolver 20 includes a frame 22, barrel 24, hand grips 26, a cylinder 28, hammer 30, trigger 32 and trigger guard 34 all of which are conventionally employed in a revolver.

As illustrated, the frame is provided with an open area 36 receiving the cylinder 28 which includes a plurality of cartridge receiving chambers 38 and is rotatably supported by a cylinder pivot shaft 40 with the external periphery of the cylinder 28 including a plurality of cylinder notches 42 corresponding with the number of chambers 38 and a pivotally mounted cylinder latch 44 engages the cylinder notches 42 for holding the chambers of the cylinder successively in alignment with the bore of the barrel 24. A firing pin 46 is mounted in a position to strike a cartridge (not shown) contained in the chamber 38 in alignment with the barrerl 24 in order to fire the firearm. A spring 48 retains the firing pin in retracted position with the hammer 30 causing the firing pin to move into engagement with the cartridge when the trigger is moved to firing position.

Figure 3:
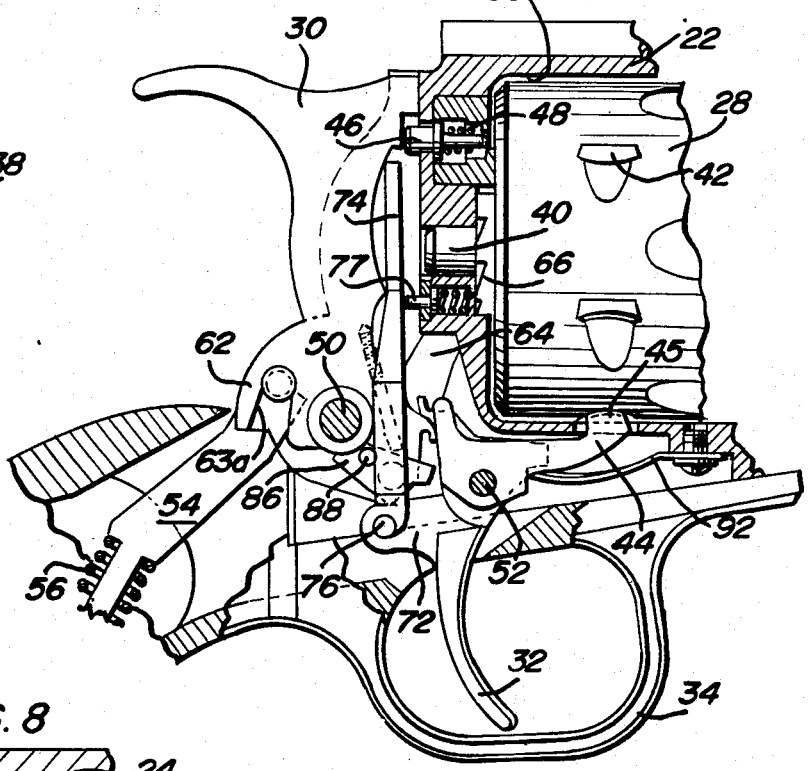
FIG. 3 is a detailed sectional view of the firearm mechanism illustrating the hammer down and at rest.
Figure 13:
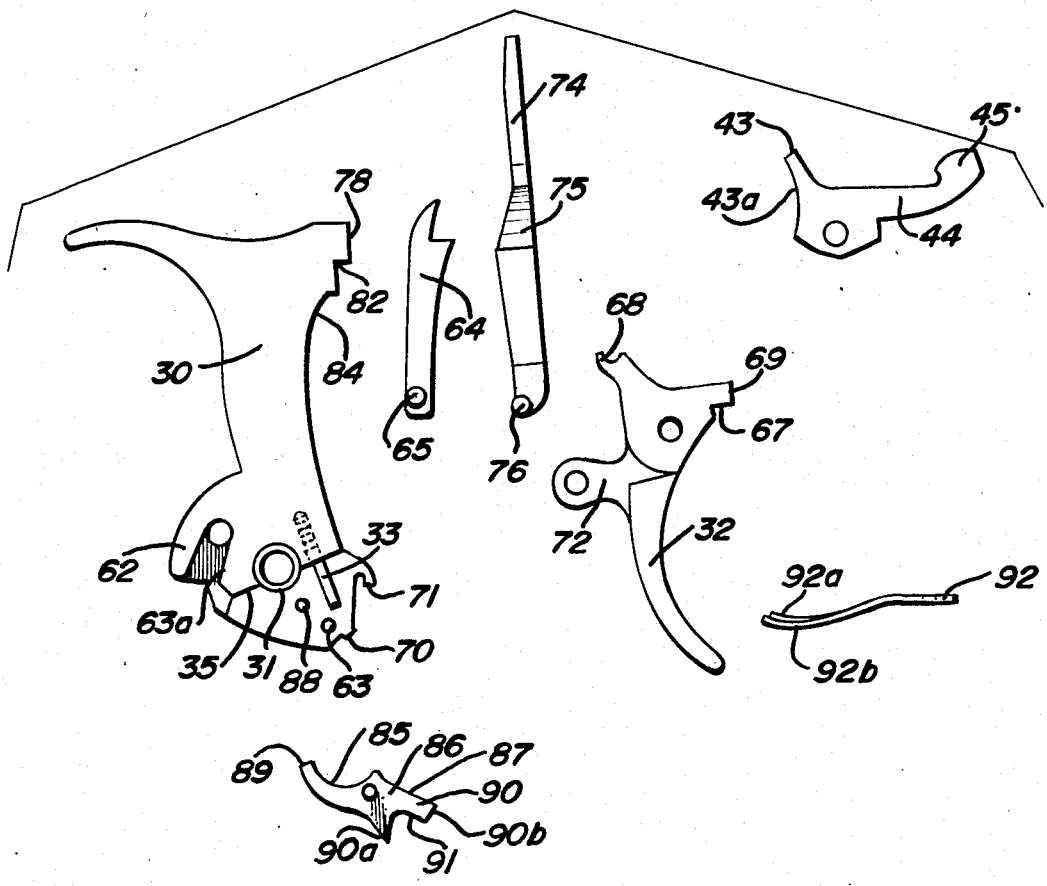
FIG. 13 is an exploded view of several components of the mechanism.

As illustrated in the drawings, the hammer 30 is pivotally supported by hammer pivot pin 50 and the trigger is pivotally supported by a trigger pivot pin 52. The hammer 30 is spring biased toward it down position about the pivot pin 50 by a strut 54 and spring 56 oriented in the hollow portion of the frame and hand grip with the upper end of the strut 54 including a yoke 58 engaging a transverse pin 60 extending between a pair of spaced ears or lugs 62 on the lower corner of the hammer 30 with one of the lugs 62 being slotted at **63*a* as illustrated in FIGS. 3, and 13. Also, the hammer 30 is pivotally connected to a cylinder pawl 64 which engages a cylinder ratchet 66 oriented around the cylinder pivot shaft 40 to cause the cylinder rotate a partial turn when the hammer 30 is rotated to its cocked position shown in FIG. 5. The pawl 64 includes pin 65 (FIG. 13) which engages a hole 63 in hammer 30. When the hammer and trigger are in their ready to fire, fully cocked positions, a sear 68 on the trigger is engaged with a sear notch 70 on hammer 30 so that when the trigger 32 is pulled, the hammer 30 will be released so that the strut spring will force it down toward the firing pin 46**.

The trigger 32 includes a rearwardly projecting arm 72 having a transfer bar 74 pivotally connected thereto by pin 76 with the transfer bar 74 extending upwardly between the frame and hammer and extending along the side of the lower portion of the hammer and then being offset inwardly at 75 so that the upper end portion thereof is positioned in alignment with the hammer 30 and in alignment with the firing pin 46 for vertical movement in response to pivotal movement of the trigger 32. Also, the transfer bar 74 is in alignment with and engaged by a spring loaded plunger 77 mounted in the frame just below the cylinder shaft 40 to spring bias the bar 74 toward hammer 30. The inner or front face of the hammer 30 is provided with a forward facing nose surface 78 and the frame includes a rearwardly facing bearing surface 80 on which the surface 78 will bear. Immediately below the surface 78 on the hammer which is in the form of a projecting nose, there is a recess 82 and a flat striking surface 84 which will engage the transfer bar 74 when in its uppermost position for driving the firing pin into engagement with the cartridge.

Figure 5:
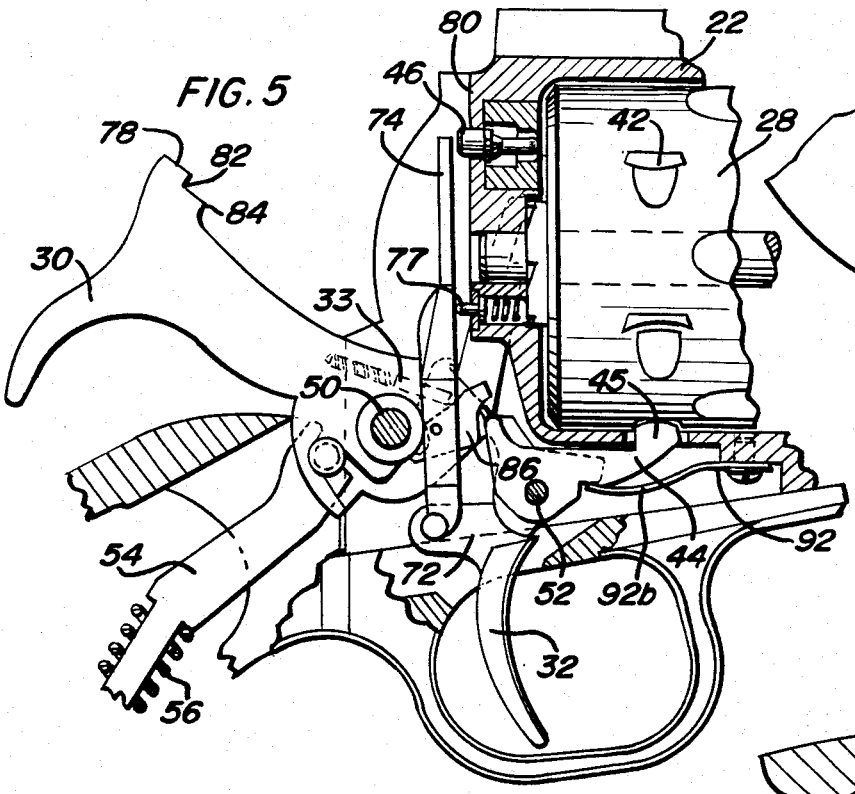
FIG. 5 is a sectional view illustrating the hammer at the full cocked position ready to fire.
Figure 6:
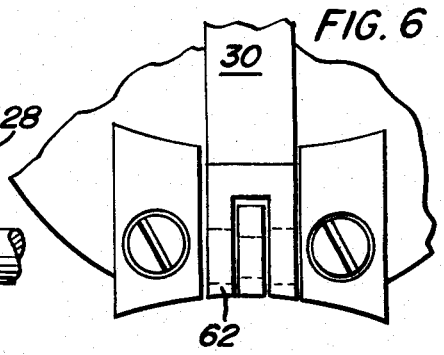
FIG. 6 is a rear fragmenta; view of the mechanism illustrating the hammer strut located in a slot in the hammer.
Figure 7:
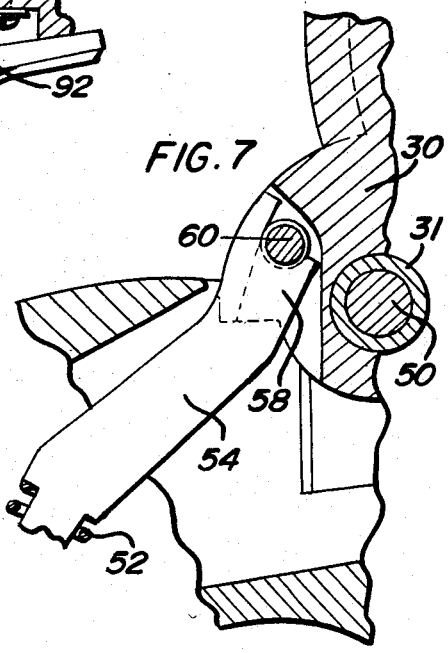
FIG. 7 is a fragmental sectional view of the hammer and strut.
Figure 4:
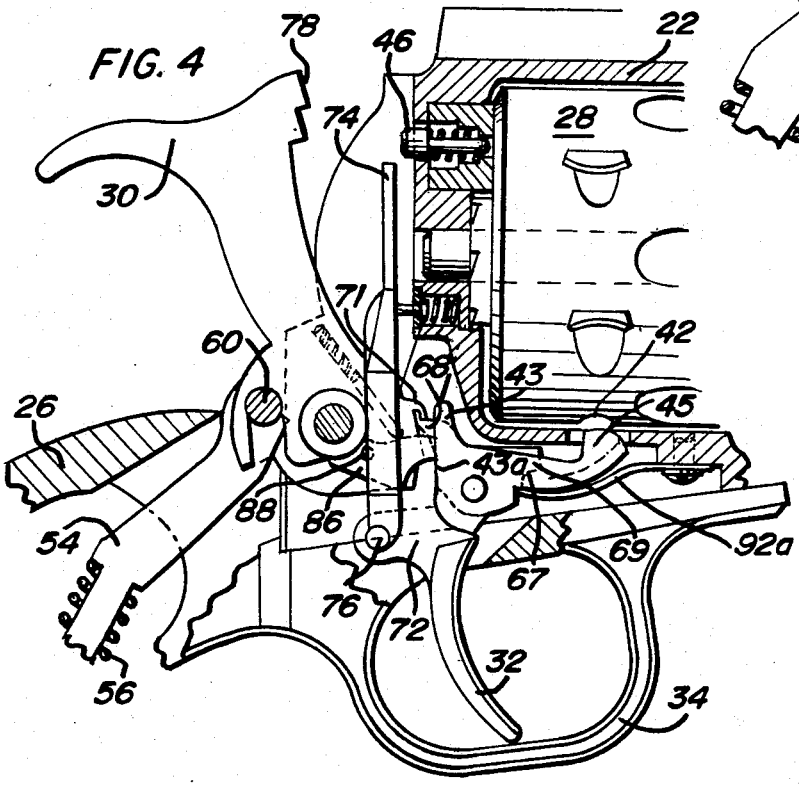
FIG. 4 is a sectional view of the mechanism illustrating the hammer at half cocked position ready to load the cylinder.
Figure 12:
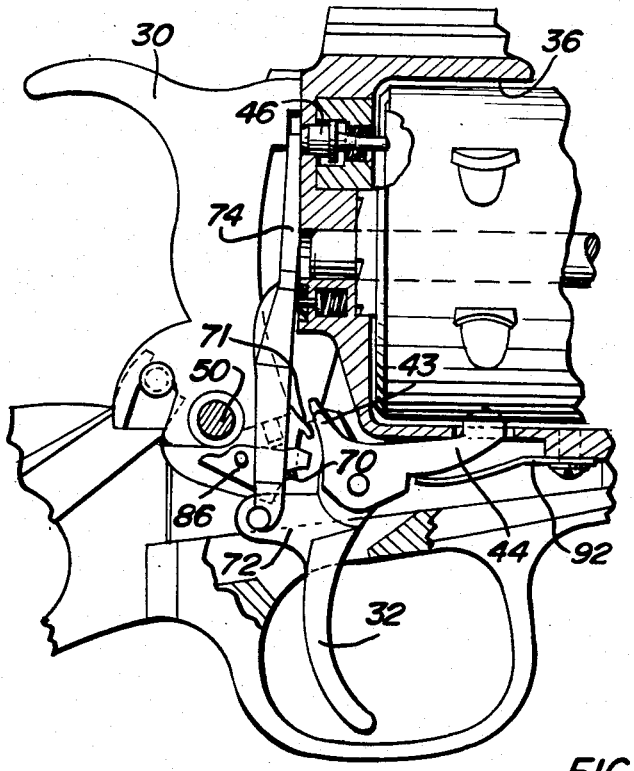
FIG. 12 is a sectional view of the mechanism when the hammer is all the way down to cartridge firing position.
Figure 11:
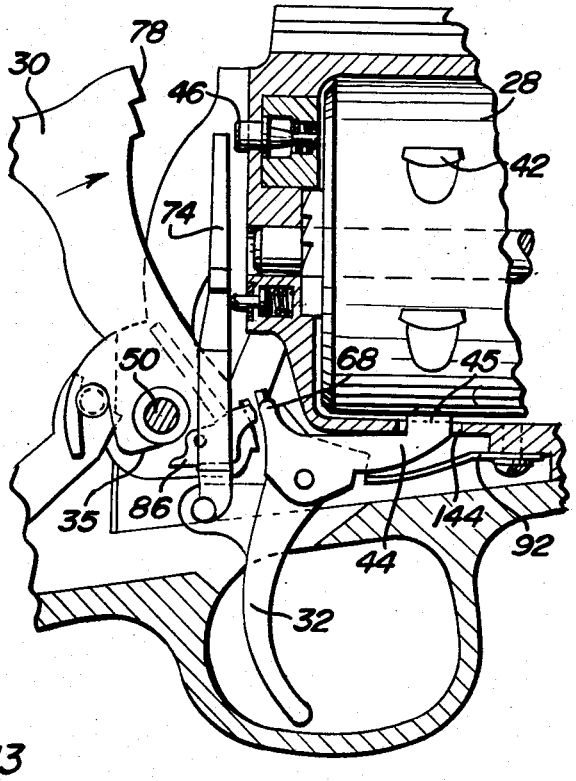
FIG. 11 is a sectional view of the mechanism when the trigger is pulled and the hammer is on the way down to firing position.

A flipper 86 prevents upward movement of the transver bar 74 until and unless the hammer 30 has been retracted from its at rest position down against the frame which is a different arrangment from that utilized in Pat. No. 3,777,384 in which the firing pin or hammer acts as a stop for the transfer bar. The flipper 86 pivots about pivot pin 88 on hammer 30 and includes a notched end surface 90 which engages and acts as a stop for the trigger arm 72 thereby preventing rearward pivotal movement of the trigger 32 and thus also acts as a stop so that the transfer bar cannot be raised for positioning between the firing pin 46 and hammer surface 84 until the hammer 30 has been retracted from its at rest position down against the frame to cam the flipper to a released position in respect to the trigger arm 72 as illustrated in FIG. 5. When the hammer is in the down and at rest position, the transfer bar cannot be elevated since the hammer flipper 86 locks the trigger from rearward pivotal movement. When in the half cock position as illustrated in FIG. 4, the trigger 32 is prevented from rotating due to the sear spur 68 being locked in the hammer half cock sear 71. However, when the hammer is retracted from its at rest position down against the frame, the flipper 86 is moved to enable the trigger 32 to be pivoted rearwardly to release the hammer and also move the transfer bar upwardly into the position illustrated in FIG. 5 with the spring loaded plunger 77 urging the transfer bar 74 to a point rearwardly of the firing pin so that the transfer bar is not stopped by the firing pin. Thus, the only way that the firing pin can be driven forward is by moving the hammer 30 to retracted from its at rest position down against the frame and then pivoting the trigger 32 rearwardly.

In more detail, the cylinder latch 44 is pivotally mounted on the trigger pivot pin 52 and includes a rounded latch end 45 which extends through an opening 144 in the frame 22 for latching engagement in one of the cylinder notches 42. The spring 92 includes two independent arms **92*a* and 92*b* which are normally in the same plane with one arm 92*a* engaging the undersurface of cylinder latch 44 and the other arm 92*b* engaging the downwardly facing surface 67 on a projecting nose 69 on a trigger 32 to bias the finger receiving lower end of the trigger 32 forwardly about pivot pin 52**.

The flipper 86 includes an arcuate upper surface 85 which engages the external surface of a cylindrical bushing 31 extending through the hammer 30 and which receives the hammer pivot pin 50. Also, the hammer 30 includes a spring biased reciprocatory pin 33 which is spaced forwardly from bushing 31 and engages the upper surface 87 of flipper 86 on the opposite side of pin 88 from the arcuate surface 85 to bias the notched end 90 downwardly about pivot pin 88 with the end 89 of the flipper 86 engaging an abutment surface 35 on hammer 30. The notched end 90 on the flipper 86 includes a lower pointed projection 90a and a blunt projection **90*b* separated by a generally triangular notch or recess 91** which has a rounded or curved inner end.

When in the at rest position shown in FIG. 3, the hammer 30 is down with the nose 78 resting against bearing surface 80 above firing pin 46, the transfer bar 74 is lowered, the trigger 32 is in a forward position, the cylinder latch 44 is engaged with a cylinder notch 42, the rear surface of the trigger 32 adjacent the sear 68 overlies the top surface of projection 71 on hammer 30, the bottom surface of projection **90*a* on flipper 86 engages the top surface of arm 72 in trigger 32 and the end 89 on flipper 86 is engaged with abutment 35 on hammer 30** thereby preventing the trigger from being pulled rearwardly thus preventing the transfer bar from moving upwardly.

When the hammer 30 is manually pivoted toward a cocked position, it will first reach a half-cocked position as illustrated in FIG. 4, during which the forward end of notched projection 71 swings about pivot pin 50 and cams sear 68 forwardly until it passes above the upper end of the sear 68 at which time the sear 68 will drop under the notched projection 71. At the same time, the blunt end **90*b* on the flipper 86 engages and cams the arcuate surface 43*a* on the cylinder latch 44 in a forward direction thereby lowering the latch end 45 so that the latch end 45 is disengaged from the cylinder notch 42 so that the cylinder 28 can rotate in one direction but cannot rotate in the other direction due to the cylinder pawl 64 engaging the cylinder ratchet 66. In this position the hammer cannot move forwardly due to engagement of sear 68 with the notched projection 71 and likewise, the trigger cannot be pulled rearwardly due to the engagement of the sear 68 with the notch in the notched projection 71 which overhangs the sear 68 as shown in FIG. 4**.

When the hammer 30 is manually moved to the fully cocked position of FIG. 5, the sear notch 70 moves about pivot pin 50 until it passes above the free end of the sear 68 with the sear 68 then engaging notch 70 and retaining hammer 30 fully cocked. At the same time, the blunt end **90*b* of flipper 86 moves above the upper end of projection 43 on the cylinder latch 44 so that the latch end 45 is biased into engagement with cylinder notch 42 by spring arm 92*a* with spring arm 92*b* biasing the sear 68 against the hammer 30 and in engagement with the sear notch 70. The transfer bar 74 is moved upwardly to the position of FIG. 5 due to the surface of the hammer 30 and notch 70 enabling limited rearward movement of trigger 32. The trigger 32 can now be pulled rearwardly to release the sear 68 from the sear notch 70 thus releasing the hammer 30** to swing forwardly to firing positions.

When the trigger 32 is moved rearwardly by firing pressure with the hammer fully cocked, the sear 68 moves forwardly out of notch 70 and transfer bar 74 moves completely to its uppermost position in alignment with firing pin 46 so that impact surface will 84 will strike transfer bar 74 and move firing pin 46 forwardly to fire the cartridge. As the hammer 30 swings forwardly about pivot 50 under the bias of compressed hammer spring 56, the edge of notch 91 which forms the blunt projection **90*b* engages the upper end of projection 43 on cylinder latch 44 with the forward end of flipper pivoting upwardly about pivot pin 88 while moving pin 33 inwardly, thereby no longer acting as stop for the hammer, until the end of blunt projection 90*b* moves rearwardly sufficiently to clear the upper end of projection 43 and move downwardly along surface 43*a* as the spring biased pin 33 causes the flipper 86 to return to its at rest position with the end 89 engaged with abutment surface 35. As the trigger 32 is released after being pulled to the firing position, it will return to its at rest position which lowers transfer bar 74** and conditions the mechanism for the next firing cycle.

With the flipper structure, the action can be made very smooth and by adjustment in length of the flipper and height of the rear end 43 of the cylinder latch 44, the timing of the action of the latch can be adjusted as desired. Proper balance of forces between the coiled hammer spring and the hammer and the flat spring operating the cylinder latch and trigger assures smooth action upon cocking the hammer and prevents the cylinder latch from dropping out of the cylinder notch upon movement of the hammer to its down position.

Figure 8:
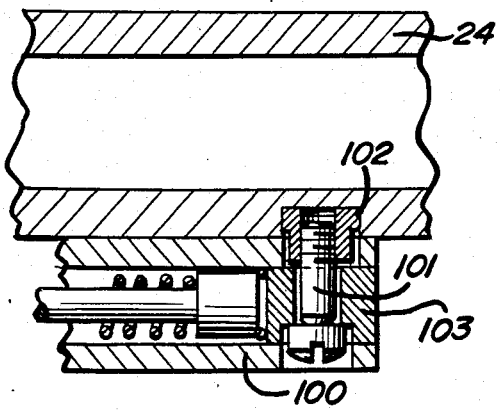
FIG. 8 is a sectional view taken along section line 8—8 on FIG. 1 illustrating the structure of an extractor attachment to the barrel.

FIG. 8 illustrates an extracting housing structure 100 secured under the barrel 24 with an extractor rod serving to remove the fired cartridge from the cylinder.

The extractor housing 100 is secured to the barrel 24 by screw 101 threaded into a barrel insert 102 which is soldered into a recess in barrel 24. A bushing 103 is inserted into the open end of the extractor housing 100. The bushing 103 is drilled and recessed to accept the head of the screw 101. The housing 100 is suitably drilled and recessed with the head of screw 101 pulling down on bushing 103 which in turn forces housing 100 down on the barrel 24.

Figure 10:
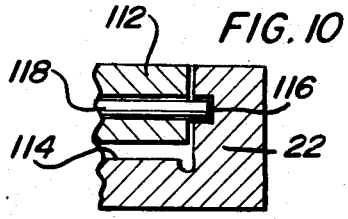
FIG. 10 is a sectional view taken along section line 10—10 on FIG. 9 illustrating the structural details of the sight mount.
Figure 2:
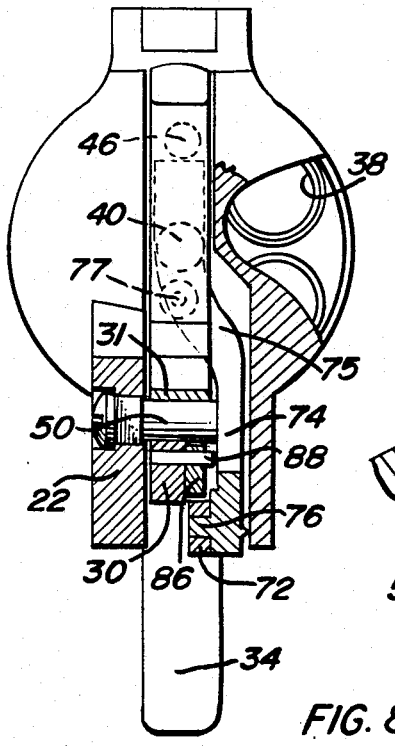
FIG. 2 is an end view of the gun of FIG. 1 with portions broken away.
Figure 9:
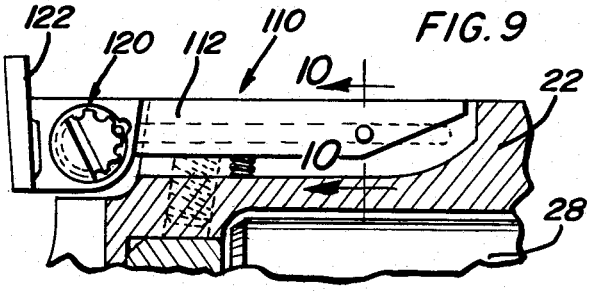
FIG. 9 is a fragmental sectional view of the rear sight mount.

FIGS. 9 and 10 illustrate a rear sight mount 110 including an elongated body 112 received in a recess 114 in the frame 22. The inner walls of the recess 114 are provided with longitudinal slots 116 receiving a transverse mounting pin 118 for the forward end of a sight body 112 to enable pivotal movement of the body 112 about a transverse axis and longitudinal movement while eliminating exposure of the pin 118 to the exterior of the frame. The rear of the sight body 112 includes adjustment arrangements 120 to enable variation in position of the rear sight member 122 in a conventional manner. This distinguishes from a transverse pin extending completely through the frame which subjects the pin to accidental dislodgement due to recoil or use and the pin is able to move forward and backward as the rear sight is raised or lowered by means of the vertical elevation screw in a well known manner thereby preventing the sight from binding or cocking when raised or lowered.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A firearm mechanism for use with a single action firearm of the type including a spring biased pivotal hammer, a pivotal trigger and means interconnecting the trigger and hammer for retaining the hammer in retracted position when manually cocked and releasing the hammer when the trigger is manually pulled, the improvement comprising means preventing firing of the firearm unless the trigger is manually pulled back even though the hammer may accidentally fall forward, said means including a flipper assembly connected with the hammer to prevent movement of the trigger until the hammer is retracted from its at rest position down against the frame, a transfer bar connected to the trigger and movable vertically between the hammer and a firing pin to transfer impact of the hammer to the firing pin when the transfer bar is elevated in response to movement of the trigger to a firing position, said flipper assembly preventing upward movement of the transfer bar to preclude it from being positioned between the hammer and the firing pin whereby the hammer will not impart impact to the firing pin.

2. The structure defined in claim 1 wherein the firearm is a revolver having a rotatable cylinder with a plurality of cartridge chambers therein successively aligned with the firing pin and firearm barrel, a cylinder latch for locking the cylinder in place when the hammer is in fully cocked position.

3. The structure as defined in claim 2 wherein said flipper assembly includes a pivotal member mounted on the hammer in spaced relation to the pivot axis of the hammer, said pivotal member having an end portion remote from its pivot axis forming a stop for engagement with the trigger, said pivotal member being pivoted to move the stop to a trigger release position when the hammer is retracted from its at rest position down against the frame.

4. A mechanism for firing a single action firearm of the type including a frame supporting a spring biased pivotal hammer, a spring biased pivotal trigger and means interconnecting the trigger and hammer for retaining the hammer in fully cocked position when manually cocked and releasing the hammer for movement to a cartridge firing position when the trigger is manually pulled, the improvement comprising a flipper that releases a cylinder lock so that it moves into engagement with notches in a rotatable cylinder for preventing rotation of the cylinder when the hammer is in the cocked position and when the hammer moves downward to fire a cartridge and when the hammer is in the fired position, a transfer bar connected to the trigger and being vertically movable between the hammer and a firing pin to transfer impact of the hammer to the firing pin when the transfer bar is elevated in response to movement of the trigger to a firing position, said flipper being pivotally mounted on the hammer and preventing full upward movement of the trasnfer bar until the hammer has been retracted from its at rest position down against the frame to preclude the transfer bar from being positioned between the hammer and the firing pin.

5. The mechanism as defined in claim 4 wherein said cylinder lock is spring biased toward latched position and being pivotally supported from the frame, said flipper including means engaged with the cylinder lock to release the lock when the hammer is in half cock position so that the cylinder can be rotated for loading with cartridges and enabling movement of the cylinder lock to cylinder locking position when the hammer is in the full cocked position.

6. The mechanisms as defined in claim 5 wherein said trigger and cylinder lock are mounted on the same pivot pin, said trigger including a rearwardly projecting arm pivotally connected to the transfer bar, said flipper including one end engaging the trigger arm and an opposite end abutting against an abutment on the hammer to prevent pivotal movement of the flipper in one direction to prevent rearward pivotal movement of the trigger thereby preventing rearward movement of the trigger and upward movement of the transfer bar until the abutment on the hammer is moved when the hammer is retracted from its at rest position down against the frame.

7. The mechanism as defined in claim 6 wherein said flipper has a notched forward end engageable with an arcuate rear surface of the cylinder lock to form said means to release the lock, said notched forward end of the flipper having an upper portion of the notched end movable above the arcuate rear surface of the cylinder lock when the hammer reaches its fully cocked position to enable the cylinder lock to latch the cylinder and enabling pivotal movement of the flipper away from the abutment to enable rearward movement of the trigger to release the hammer and to enable downward movement of the opposite end of the flipper in relation to the pivot axis of the hammer to return to position against the abutment and the forward end engaged with the arcuate rear surface of the cylinder lock.

8. The mechanism as defined in claim 4 wherein said frame includes a rear sight, means mounting the rear sight on the frame above the cylinder and hammer, said means mounting said sight incuding a longitudinal recess in the top surface of the frame, said recess including a longitudinal groove in each sidewall, a sight body received in said recess, a transverse pin in said sight body with the ends of the pin being slidably disposed in said grooves to enable movement of the sight body without exposing the ends of the pin.

9. The mechanism as defined in claim 4 wherein said spring biased pivotal hammer includes a pivot pin mounting the hammer to the frame, an elongated strut having one end engaged with the hammer in spaced relation to the pivot pin with the other end slidable in relation to the frame, a coil spring encircling the strut and biasing the strut to bias the hammer downwardly toward firing position.

10. The mechanism as defined in claim 9 wherein said hammer includes a pair of spaced lugs receiving the strut therebetween a connecting pin extending through the lugs and strut, one of said lugs having a slot extending to an edge thereof receiving the connector pin to facilitate assembly, said lugs being closely adjacent to frame surfaces to prevent removal of the connector pin when the hammer and strut are assembled into the frame.

11. In a firing mechanism for a single action firearm of the type including a frame supporting a rotatable cylinder with circumferentially spaced cartridge chambers, a spring biased pivotal hammer, a spring biased pivotal trigger and means interconnecting the trigger and hammer for retaining the hammer in fully cocked position when manually cocked and releasing the hammer for movement to a cartridge firing position when the trigger is manually pulled, the improvement comprising a cylinder lock mounted on the frame for engagement with the cylinder for preventing rotation of the cylinder when the hammer is in the cocked position and when the hammer moves downward to fire a cartridge in a firing chamber and when the hammer is in the fired position, a transfer bar connected to the trigger and being vertically movable to a position between the hammer and a firing pin to transfer impact of the hammer to the firing pin when the transfer bar is elevated in response to movement of the trigger to a firing position, and a flipper pivotally mounted on the hammer and associated with the hammer, trigger and cylinder lock for preventing full upward movement of the transfer bar until the hammer has been retracted from its at rest position down against the frame to preclude the transfer bar from being positioned between the hammer and the firing pin.

12. The mechanism as defined in claim 11 wherein said cylinder lock is spring biased toward latched position and being pivotally supported from the frame, said flipper including means engaged with the cylinder lock to release the lock when the hammer is in at least half cock position.

13. The mechanism as defined in claim 12 wherein said trigger and hammer are interconnected by a sear which becomes operative only when the hammer is pivoted to at least a half cocked position.

* * * * *